United States Patent [19]

Kondo

[11] Patent Number: 4,804,295

[45] Date of Patent: Feb. 14, 1989

[54] SHIELDED TUNNEL EXCAVATOR

[75] Inventor: Yasunori Kondo, Kakogawa, Japan

[73] Assignee: Kawasaki Jukogyo Kabushiki Kaisha, Hyogo, Japan

[21] Appl. No.: 119,071

[22] Filed: Nov. 10, 1987

[30] Foreign Application Priority Data

Nov. 13, 1986 [JP] Japan ..... 61-270293

[51] Int. Cl.[4] ..... E21D 9/06

[52] U.S. Cl. ..... 405/141; 299/31; 405/138; 405/146

[58] Field of Search ..... 405/141, 138, 146, 142, 405/139, 140; 299/31, 33

[56] References Cited

FOREIGN PATENT DOCUMENTS 920972 1/1977 Japan .

*Primary Examiner*—Dennis L. Taylor

*Attorney, Agent, or Firm*—Wenderoth, Lind & Ponack

[57] ABSTRACT

A tunnel excavator has a substantially tubular shield having rotatably mounted on one end a motor-driven cutting disk rotatably carrying a multiplicity of roller cutters. The shield is comprised of a head section having front anchors in addition to the cutting disk, an inner section telescopically nested in the head section and constrained to only axial displacement relative to the same, and a tail section having rear anchors and coupled to the inner section for both bending and rolling movements relative to the same. Hydraulic push jacks act between the head and tail shield sections for advancing the shield. A pair of hydraulically independent antirolling jacks are connected between the inner and tail shield sections so as to enable the tail shield section, which is anchored during excavation, to bear against the rolling of the head shield section.

10 Claims, 8 Drawing Sheets

SHIELDED TUNNEL EXCAVATOR

BACKGROUND OF THE INVENTION

This invention relates to tunnel excavators, and more specifically to a tunnel excavator of the type having a substantially tubular shield, and a rotary cutting disk on one end of the shield carrying a plurality or multiplicity of cutting tools such as cutter rollers. The tunnel excavator of this general configuration is suitable for tunneling in relatively hard soils or rocks.

Mechanical tunneling with shielded excavators is now a standard practice in the earthmoving industry. The shielded tunnel excavator in general cuts the ground by revolving the cutting disk fitted with roller cutters or teeth cutters and advances by the extension and contraction of hydraulic push jacks connected between discrete sections of the shield. Additionally, the excavator has been constructed for supporting the already excavator bore by its skin plate and tail shield and is further provided with a segment errector within the tail shield for lining the tunnel surface with concrete segments or equivalents. The reactive forces that are produced by excavation, by excavator advancement, and by cutting disk rotation have all been transmitted via the push jacks to the erected liner segments thereby to be borne.

Usually, the cutting disk is fitted with teeth cutters (shown at 3 in FIG. 14) for excavating softer soils but with roller cutters (1) for cutting into harder rocks or other formations. The muck or spoil produced by excavation may be water-slurried and discharged through a conduit system, although belt conveyors or screw conveyors are possible and familiar alternative means of spoil disposal. Several problems have been encountered with this type of tunnel excavator.

First, as the tunnel diameter must be greater than the shield diameter for smooth advancement of the excavator, the resulting clearance gives rise to the chance of the rolling of the machine due to reaction from the tunnel face as the cutting disk rotates in cutting engagement therewith. It has been practiced to bidirectionally rotate the cutting disk in order to minimize the rolling. This known practice is objectionable, however, since it may ruin that teeth cutter (3*a*) opposite to the one acting as scraper (FIG. 14).

Second, excavation must be suspended during liner segment erection after each unit distance advance of the machine, because the reaction of excavation must be borne by the erected segments.

Japanese Pat. No. 920,972 (Publication No. 52-2218) proposes a solution to the above noted problems. The tunnel excavator according to this patent has a shield which is discretely divided into a head section and a tail section, with the latter telescopically nested in the former. This proposed shield construction has its own weaknesses, as discussed in detail hereafter.

The two nested shield sections must have a sufficient clearance therebetween to allow for the steering of the excavator. As the machine is actually steered, the shield sections may go out of alignment with each other to such an extent that a large gap may be created on one side of the machine (FIG. 15). Should the spoil be caught in this gap, the shield sections may become incapable of aligning themselves subsequently. The lapping portions of the shield sections are sealable against spoil intrusion only by use of very complex and expensive means. For this reason the prior art machine permits spoil disposal only by means of a belt conveyor, and not be slurrying the spoil and pumping out the slurry.

A further objection to the above patended machine resides in a pair of fluid actuated cylinders pivotally mounted between the head and tail shields for transmitting the contrarotation of the cutting head to the anchored tail shield during excavation. These cylinders must pivot during the advancement of the machine, as such advancement necessitates the relative axial displacement of the shield sections between which the cylinders are connected. The space requirements of the cylinders are therefore very large, no other equipment being mountable in the paths of their pivotal motions. Still further, the cylinders demand a complex hydraulic circuit as they must be hydraulically interconnected for synchronized operation. It is an additional disadvantage that the cylinders must be of bulky and sturdy construction as they are required to bear the reactive forces of excavation in coaction with the anchors on the rear shield.

SUMMARY OF THE INVENTION

The present invention solves the problems of how to most effectively take up the rolling of a tunnel excavator during excavation, how to avoid the intrusion of loose soil or spoil into the shield during a change in the direction of advance, and how to speed the construction of the tunnel.

Briefly, the invention may be summarized as a shielded tunnel excavator comprising a substantially tubular shield, a rotary cutting disk rotatably mounted to one end of the shield and itself rotatably carrying a plurality or multiplicity of cutting bits such as cutter rollers for cutting engagement with the face of a tunnel being excavated, and drive means within the shield for imparting rotation to the cutting disk. The shield is divided in accordance with the invention into a head section having front anchor means, an inner section telescopically nested in the head section and rigidly constrained to axial displacement relative to the same, and a tail section having rear anchor means and both steerably and rollably coupled to the inner section. Propelling means such as hydraulic push jacks are connected between the head section and tail section of the shield. Further a pair of antirolling jacks are connected between the inner section and tail section of the shield so as to extend tangentially of the shield.

One of the most pronounced features of the above outlined invention is that the shield is divided into three discrete sections, instead of into two sections as in the noted prior art. The joint between the head and inner sections and that between the inner and tail sections can be easily and reliably sealed against spoil intrusion. This improved shield configuration permits spoil disposal either by conveyors or by slurrying the spoil and pumping out the slurry.

Another notable advantage of the invention is that the rolling or contrarotation of the head shield section, caused by the rotation of the cutting disk in cutting engagement with the tunnel face, can be taken up by the tail shield section which is held anchored during excavation. The contrarotation of the head shield section is first transmitted to the inner shield section, which is incapable of rotation relative to the head shield section, and thence to the tail shield section via the pair of antirolling jacks.

It should also be appreciated that, unlike the prior art, the pair of antirolling jacks need not be supported for pivotal motion in the axial direction of the shield. Accordingly, they make no space requirements within the inner and tail shield sections. Further the jacks can be hydraulically independent of each other, so that they can be far simpler and less bulky and expensive than their conventional counterparts, assuring a troublefree operation throughout the expected lifetime of the excavator.

As an additional advantage, the erection of liner segments or other tunnel supports can be concurrent with excavation since the machine can be thrusted forwardly immediately upon re-anchoring of the tail shield section to the tunnel surface, rather than after the erection of tunnel supports.

The above and other features and advantages of this inventon and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENTS

Figure 1:
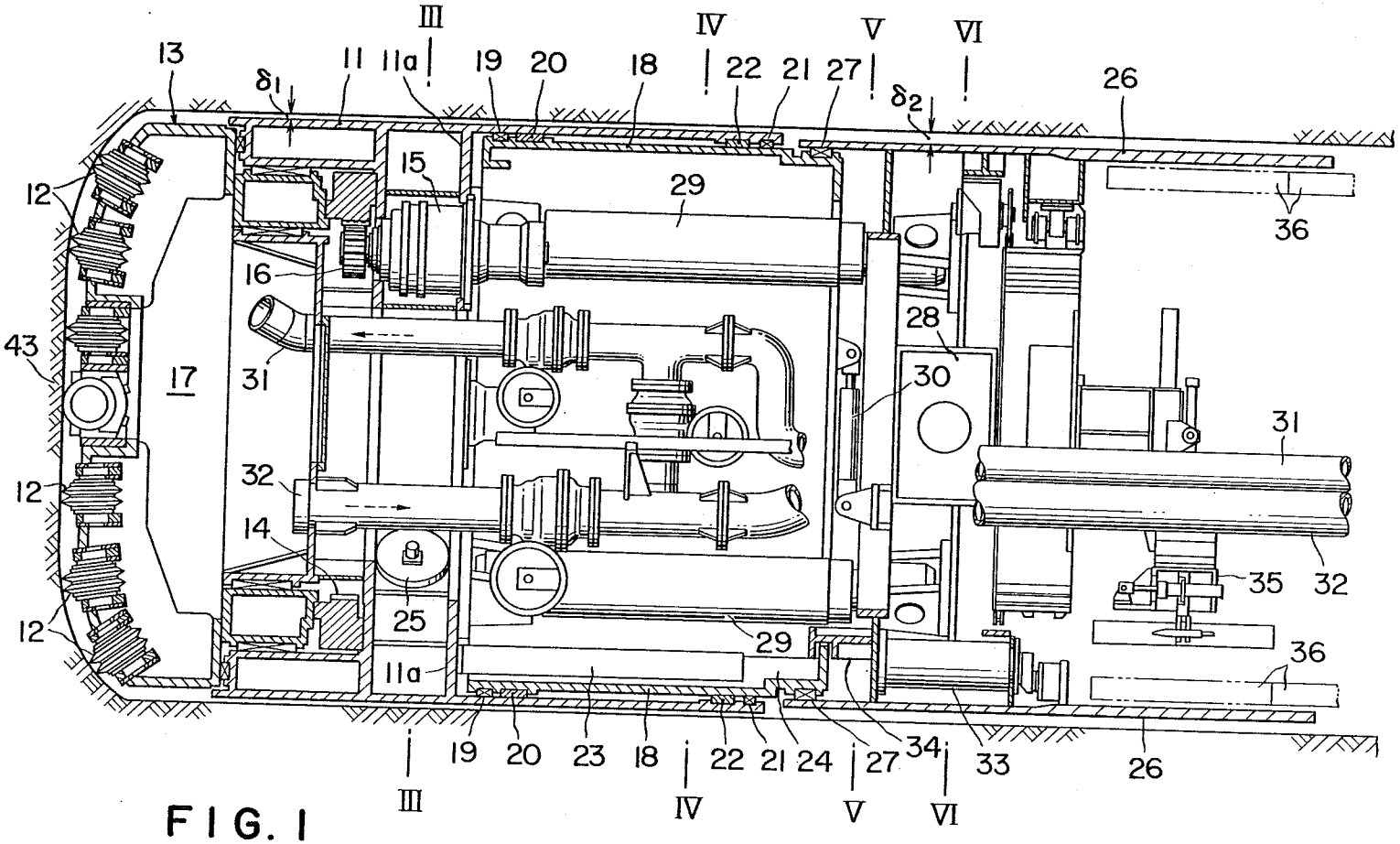
FIG. 1 is a longitudinal section, with parts shown in elevation, through the tunnel excavator embodying the principles of the invention, the excavator being shown in the act of tunneling.
Figure 2:
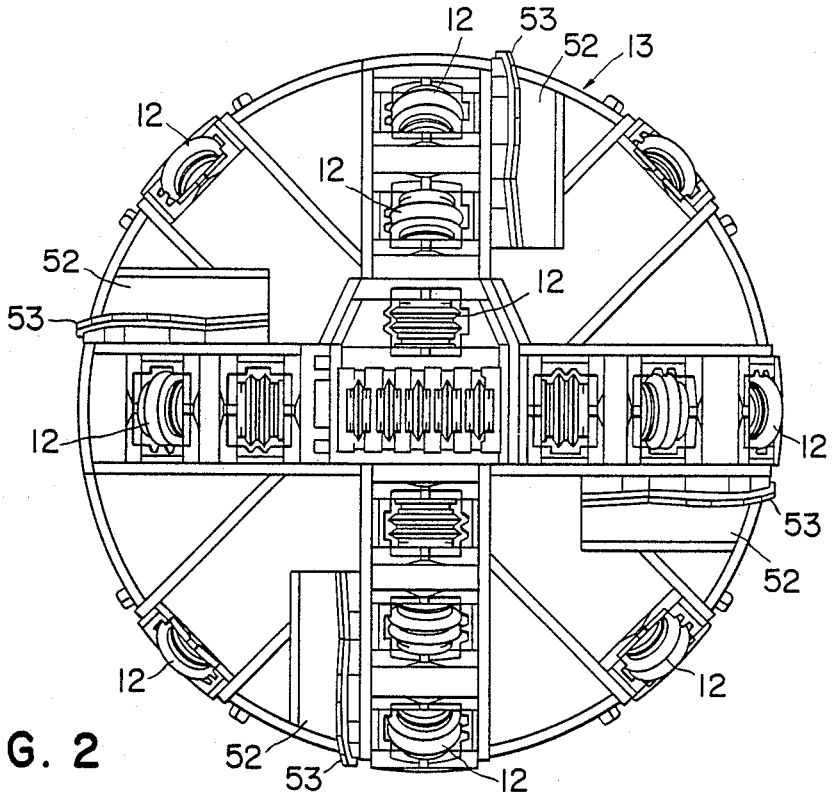
FIG. 2 is a front or left hand end elevation of the excavator of FIG. 1.

With reference first and in particular to FIG. 1, which shows the representative tunnel excavator of the invention in the act of tunnel excavation, the excavator is provided with a generally tubular shield comprising a head section 11, an inner section 18, and a tail section 26. Concentrically mounted to the front end, shown directed to the left in FIG. 1, of the head shield section 11 is a cutting disk 13 which is rotatable relative to the head shield section about the same axis therewith. As will be seen also from FIG. 2, a front end view of the excavator, a plurality or multiplicity of roller cutters 12 are replaceably mounted to the cutting disk 13 in a pattern designed for the most efficient cutting of the tunnel face 43. The construction of each roller cutter 12, and the method and means for its mounting to the cutting disk 13, will be later explained in more detail.

Figure 3:
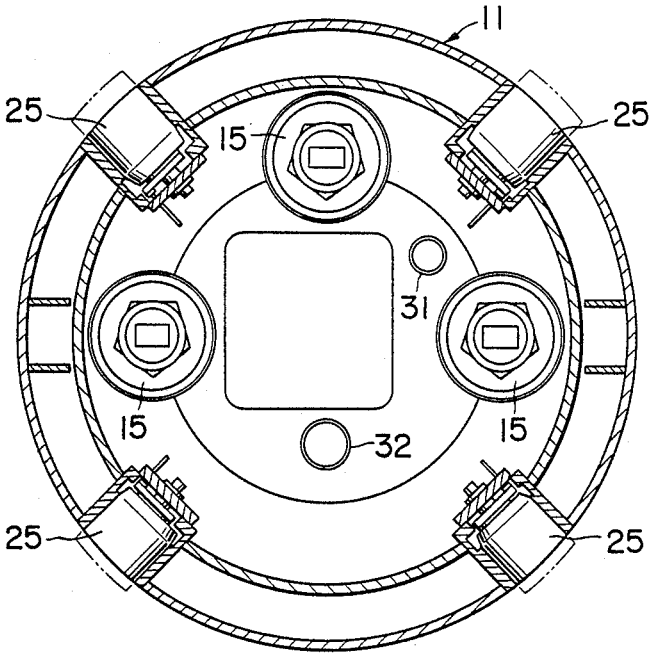
FIG. 3 is a cross section through the excavator, taken along the line III—III in FIG. 1.

Employed for the desired rotation of the cutting disk 13 with respect to the shield are a plurality of, three in the illustrated embodiment, drive motors 15, FIGS. 1 and 3, which are rigidly supported within the head shield section 11. Pinions 16 on the armature shafts of the drive motors 15 mesh with an internal gear 14 which is concentrically coupled fast to rear end of the cutting disk. It is thus seen that the drive motors 15 conjointly drive the cutting disk 13 via the intermeshing gear 14 and pinions 16. A slurry chamber 17 is water-tightly defined just behind teh cutting disk 13.

Figure 4:
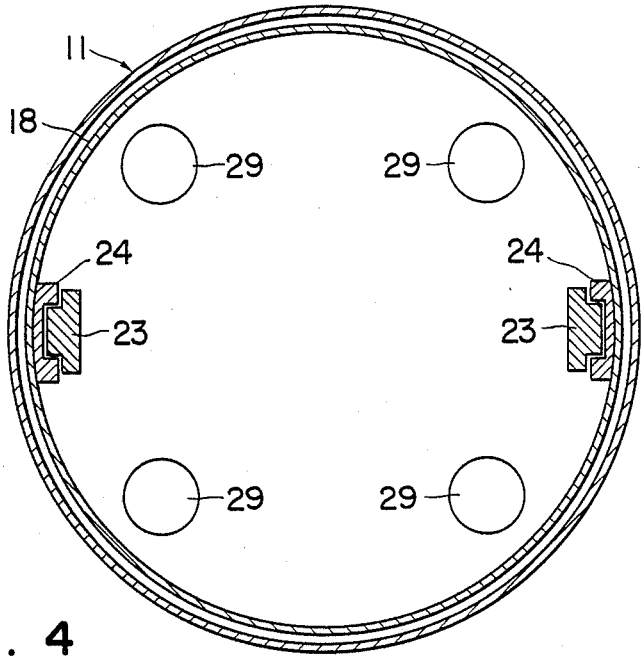
FIG. 4 is also a cross section through the excavator, taken along the line IV—IV in FIG. 1.

FIGS. 1 and 4 indicate that the inner shield section 18 is concentrically nested in a rear part of the head shield section 11 for axial displacement relative to the same. The inner shield section 18 has a front sealing ring 19 and front bushing 20 rigidly mounted on the outside surface of its front end portion for sliding contact with the inside surface of the head shield section 11. A rear sealing ring 21 and rear bushing 22 are rigidly mounted on the inside surface of the rear end portion of the head shield section 11 for sliding contact with the outside surface of the inner shield section 18.

It will also be observed from FIGS. 1 and 4 that a pair of slides 23 are disposed in diametrically opposite positions within the inner shield section 18 and extend parallel to its axis. The slides 23 have their front ends secured to an annular partition **11*a* which is formed in one piece with the head shield section 11 and which is disposed just forwardly of the inner shield section 18. The slides 23 are slidably engaged in respective channel-shaped guides 24 secured to the inside surface of the inner shield section 18, so that the head shield section 11 and inner shield section 18 are slidable axially relative to each other while being restrained from relative angular and radial displacement. It is, of course, understood that the head shield section 11 and inner shield section 18** could be splined together or otherwise interengaged in any other convenient manner for such relative displacement in the axial direction only.

As seen in both FIGS. 1 and 3, the head shield section 11 is provided with a plurality of, four in this embodiment, front anchor mechanisms 25 disposed at constant circumferential spacings thereon. Each front anchor mechanism can be of any known or suitable construction comprising, for example, a hydraulic jack for thrusting an anchor member radially outwardly of the head shield section 11 to establish a positive anchorage thereof against the surface of the tunnel being excavated.

With reference directed further to FIG. 1 the tail shield section 26 is disposed in end-to-end relation with the head section 11, with a spacing therebetween, and in overlapping relation to the inner shield section 18. A collapsible seal 27 between the lapping ends of the inner shield section 18 and tail shield section 26 permits the radial play of the inner shield section, and therefore of the head shield section 11, relative to the tail shield section 26. In other words, the head shield section 11 as well as the inner shield section 18 is steerable with respect to the tail shield section 26.

Figure 6:
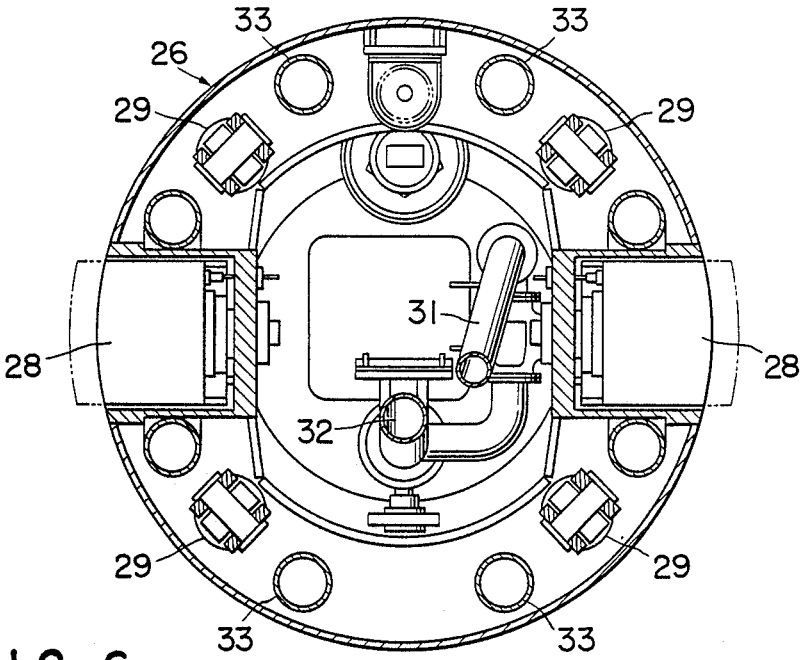
FIG. 6 is also a cross section through th excavator, taken along the line VI—VI in FIG. 1.

As depicted cross-sectionally in FIG. 6, the tail shield section 26 is provided with a plurality of, two in this embodiment, rear anchor mechanisms 28 at constant circumferential spacings. The rear anchor mechanisms 28 perform the function of positively anchoring the tail shield section 26 to, and releasing the same from, the tunnel surface.

FIG. 1 clearly indicates that the outside diameter of the tail shield section 26 is less than that of the head shield section 11. Therefore, the gap (tunnel overcut) $\delta 1$ between the head shield section 11 and the tunnel surface is less than the gap $\delta 2$ between the tail shield section 26 and the tunnel surface. This difference between the overcuts is intended to expedite the advance of the tail shield section 26 through the reduction of the frictional resistance.

Figure 5:
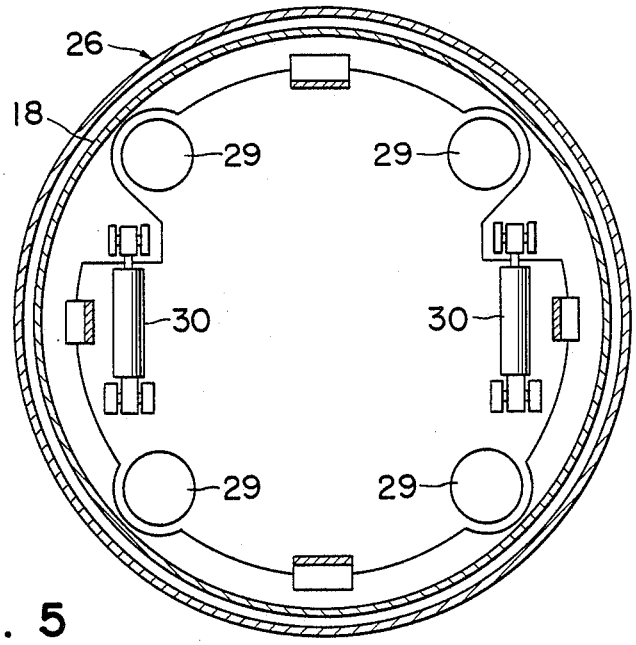
FIG. 5 is also a cross section through the excavator, taken along the line V—V in FIG. 1.

The head shield section 11 and tail shield section 26 are interconnected by a plurality of, four in this embodiment, hydraulic push jacks 29, FIGS. 1, 5 and 6, disposed circumferentially within the inner shield section 18. The push jacks 29 propel the shield, and therefore the complete excavator, as excavation proceeds.

As seen in FIG. 1 and more clearly in FIG. 5, a pair of antirolling jacks 30 are mounted between the inner shild section 18 and the tail shield section 26, and in symmetrical positions with respect to the shield axis. Disposed in a plane at right angles with the shield axis, the antirolling jacks 30 extend parallel to each other in positions of symmetry about the shield axis. Each antirolling jack 30 is coupled at one end to the rear end of the inner shield section 18 and at the other end to the front end of the tail shield section 26. Thus the reactive (rolling) force exerted on the head shield section 11 by the cutting disk 13 during excavation is transmitted to the tail shield section 26 via the interfitting slides 23 and guides 24, the rear anchor mechanisms 28, and the antirolling jacks 30.

Figure 7:
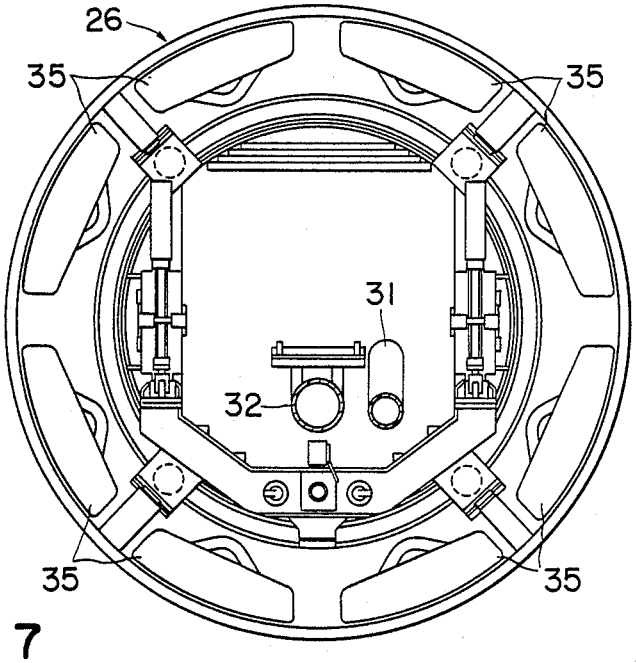
FIG. 7 is a rear or right hand elevation of the excavator of FIG. 1.

Both FIGS. 1 and 7 show a water conduit 31 extending through the tail shield section 26 and inner shield section 18 into the slurry chamber 13 for the delivery of water thereto. The water thus fed into the slurry chamber 13 will mingle with the spoil to form a slurry. The slurried spoil is to be withdrawn from the slurry chamber 17. through a slurry conduit 32 extending rearwardly therefrom through the inner shield section 18 and tail shield section 26.

At 33 in FIGS. 1 and 6 are shown auxiliary push jacks designed to transmit the thrusts of the primary push jacks 29 to a series of tunnel liner segments 36 which has been installed by an erector mechanism 35 of any known or suitable construction within the tail shield section 26. Additionally, as required, the auxiliary push jacks 33 may be used for propelling the excavator by themselves. Coupling bars 34 serve the purpose of interconnecting the inner shield section 18 and tail shield section 26 so as to permit the relative bending and rolling of the head and tail shield sections 11 and 26.

Figure 8:
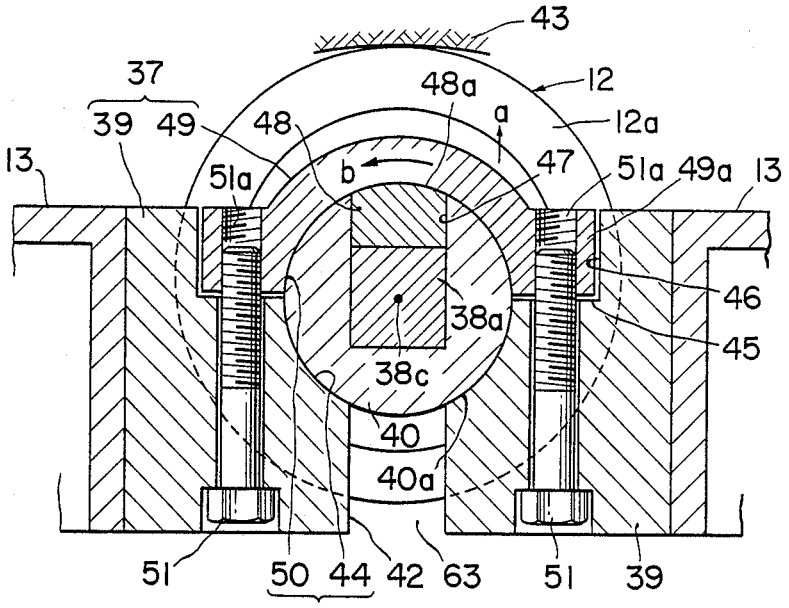
FIG. 8 is an enlarged section through replaceable mounting means for each roller cutter on the cutting disk of the excavator of FIG. 1, the section being taken along a plane at right angles with the roller cutter axis.
Figure 9:
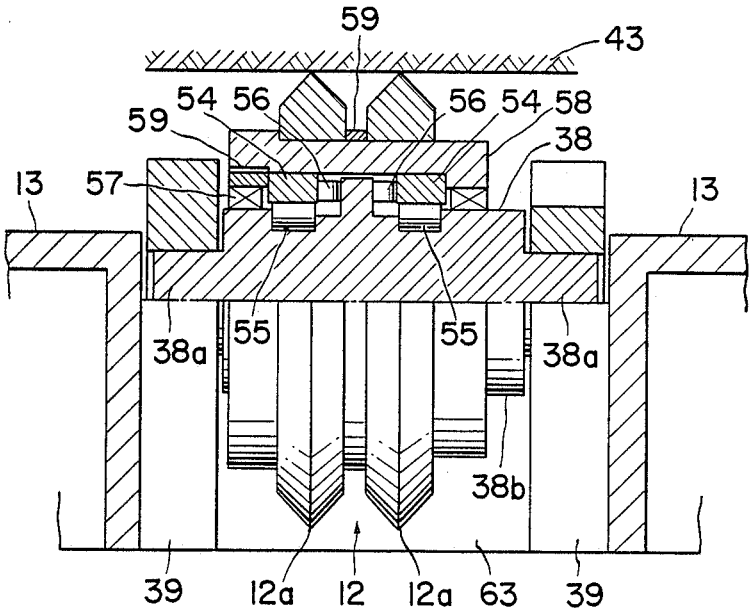
FIG. 9 is an axial section, half in elevation, through the roller cutter shown together with the replaceable mounting means.

As drawn on an enlarged scale in FIGS. 8 and 9, each roller cutter 12 comprises one or more, two in this embodiment, cutter rings **12*a* rotatably mounted on a cutter shaft 38 in a manner to be described presently. It will also be noted from FIG. 8 in particular that each roller cutter 12 is replaceably mounted to the cutting disk 13 via mounting means 37 comprising fixed cutter supports 39 and clamps 49. The cutter shaft 38 has a pair of extensions 38*a* of rectangular cross sectional shape extending collinearly from its opposite ends. FIG. 8 illustrates how each cutter shaft extension 38*a* is supported by the mounting means 37 via a rotary mounting disk 40**, as set forth in detail hereafter.

The cutter support 39 and clamp 49 define in combination a circular opening 41 for receiving the rotary mounting disk 40. The axis of this circular opening 41 is aligned with, or parallel to, the axis of the cutter shaft 38. Approximately one half of the circular opening 41 is formed by a semicircular recess 44 in the cutter support 39, and the other half by a semicircular recess 50 in the clamp 49. The semicircular recess 44 in the cutter support 39 is open to a guide channel 42 extending radially therefrom toward the interior or rear side of the cutting disk 13 for the passage of the cutter shaft extension **38*a* during the mounting and dismounting of the cutter roller 12. The cutter support 39 has further formed therein a generally rectangular recess 46 which is bounded in part by a pair of seating surfaces 45 for supporting the clamp 49, although the provision of this recess 46 is not a necessity. As viewed in FIG. 8, the circular opening 41, guide channel 42 and recess 46 are of bilateral symmetry with respect to a plane passing the axis of the cutter shaft 38 and extending perpendicular to the tunnel face 43**.

The rotary mounting disk 40 has itself defined therein a radial slot 47 for receiving the cutter shaft extension **38*a* and filler 48 with a sliding fit. The filler 48 has a surface 48*a* which is flush with the outer surface 40*a* of the mounting disk 40 and which is curved with the same radius as the mounting disk surface 40*a*, so that the filler surface 48*a* and mounting disk surface 40*a*** provides in combination an unbroken cylindrical surface.

The clamp 49 has a pair of leg portions **49*a* seated against the seating surfaces 45 of the cutter support 39. Machine screws 51 are inserted into and through clearance holes in the cutter support 39 and engaged in tapped holes 51*a* in the leg portions thereby fastening the clamp 49 to the cutter support and so clamping the rotary mounting disk 40 together with the cutter shaft extension 38*a* engaged therewith. The clamp 49 serves to prevent the cutter shaft 38 from falling off the cutter support 39 toward the tunnel face 43. Therefore, as had been stated, the mounting of the clamp legs 49*a* to the recessed seating surfaces 45 on the cutter support 39** is unessential; instead, the clamp legs could be mounted to the extreme front face of the cutter support.

So mounted to the cutting disk 13, the roller cutters 12 are arranged thereon for the even cutting of the complete tunnel face 43. It will also been seen from FIG. 2 that the cutting disk 13 is additionally provided with scrapers 53, disposed adjacent spoil intakes 52, which coact with the roller cutters 12 for optimal excavation.

FIG. 9 clearly illustrates how the two cutter rings **12*a* of each roller cutter 12 are mounted on the cutter shaft 38. The cutter rings 12*a* are mounted fast on a rotary sleeve 58, with an annular spacer 59 between the cutter rings. The sleeve 58 in turn is rotatably mounted on the cutter shaft 38 via cages 54, radial bearing rollers 55, and thrust bearing rollers 56. A pair of sealing rings 57 are engaged between cutter shaft 38 and rotary sleeve 58. An annular threaded member 59 locks the rotary sleeve 58 against axial displacement relative to the cutter shaft 38**.

FIG. 9 also reveals a tool grip **38*b* formed in one piece with the cutter shaft 38 and left exposed from the rotary sleeve 58. As seen in an end view as in FIG. 10, the tool grip 38*b* is of hexagonal shape, although it could be of other noncircular shape, all that is required being that it be firmly gripped with a wrench or other tool for manually revolving the cutter shaft 38 together with the rotary mounting disk 40 in mounting or dismounting the roller cutter 12. It may also be mentioned that the cutter shaft extensions 38*a* need not be of rectangular shape, either. The cutter shaft extensions could be, for example, circular in cross section, even though such circular shaft extensions might slip with respect to the mounting disks 40** during excavation.

It is to be noted that the axis **38*c* of the cutter shaft extensions 38*a* need not be in precise alignment with the axis 40*b* of the rotary mounting disks 40 as shown in FIG. 8. Alternatively, the axis 38*c* may be offset from the axis 40*b* either toward the tunnel face, as shown in FIG. 11, or away from the same. Either way, the roller cutter 12 will be dismountable from the cutting disk 13 by revolving the roller cutter about the axis 38*c* or 40*b*, as will be more fully explained subsequently. In cases where the cutter shaft is eccentric with respect to the rotary mounting disk 40, the clamp 49 may be provided as required with a stop 60, FIG. 10, which is to be abutted upon by the periphery 38*d* of the tool grip 38*b***, thereby positively locking the cutter shaft against undesired rotation.

Figure 12A:
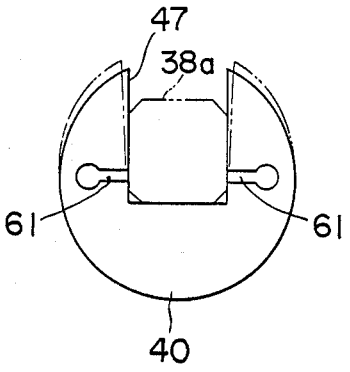
FIG. 12A is an illustration of an alternative form of rotary mounting disk included in the replaceable mounting means for each roller cutter.
Figure 12B:
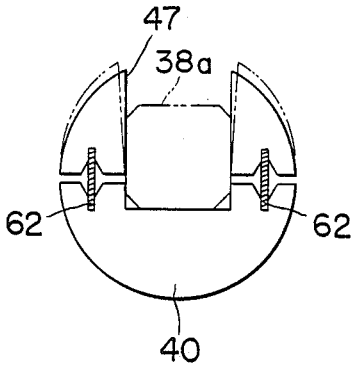
FIG. 12B is an illustration of another alternative form of rotary mounting disk.

As additional possible modifications of the invention, each rotary mounting disk 40 may be either slitted as at 61 in FIG. 12A or divided into segments as shown in FIG. 12B, with the disk segments interconnected by springs 62. These slitted and segmented mounting disks are both intended to facilitate the insertion of the cutter shaft extension **38*a* in their radial slots 47, as these slots will resiliently spread wider during such insertion. As an added advantage, the radial slots 47 will become narrower as the clamp 49 is screwed to the cutter support 39, thereby making it possible for the mounting disk 40 to hold the cutter shaft extension 38*a*** more firmly.

The following is a discussion of a method of dismounting each roller cutter 12 from the cutting disk 13. Let us assume that the roller cutter 12 with its mounting means 37 is in the state of FIG. 8, with the radial slot 47 in the rotary mounting disk 40 opening toward the tunnel face 43. The operator, lying behind the cutting disk 13, first loosen the screws 51 to an extent necessary to slightly move the clamp 49 away from the mounting disk 40 as indicated by the arrow a in FIG. 8. Then with an appropriate hand tool inserted in the space 63, FIGS. 8, 9 and 11, between the cutter supports 39, the tool grip **38*b* is turned 180 degrees as indicated by the arrow b in FIG. 8. Thereupon the rotary mounting disk 40 will revolve from its FIG. 8 position to that of FIG. 13, in which latter position the radial slot 47 in the mounting disk 40 is open to the guide channel 42 in the cutter support 39. Now the roller cutter 12 together with the cutter shaft 38 and the associated bearing means and fillers 48 is withdrawn from the cutter supports 39**.

Figure 10:
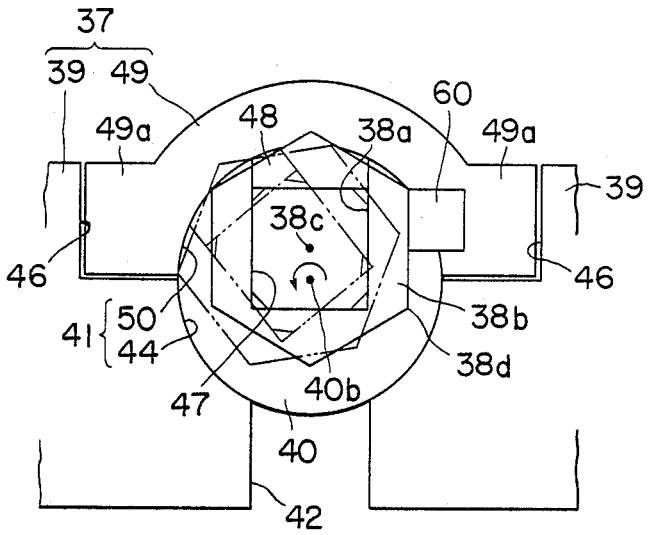
FIG. 10 is a diagramatic illustration explanatory of the way in which each roller cutter is mounted to and dismounted from the cutting disk.
Figure 11:
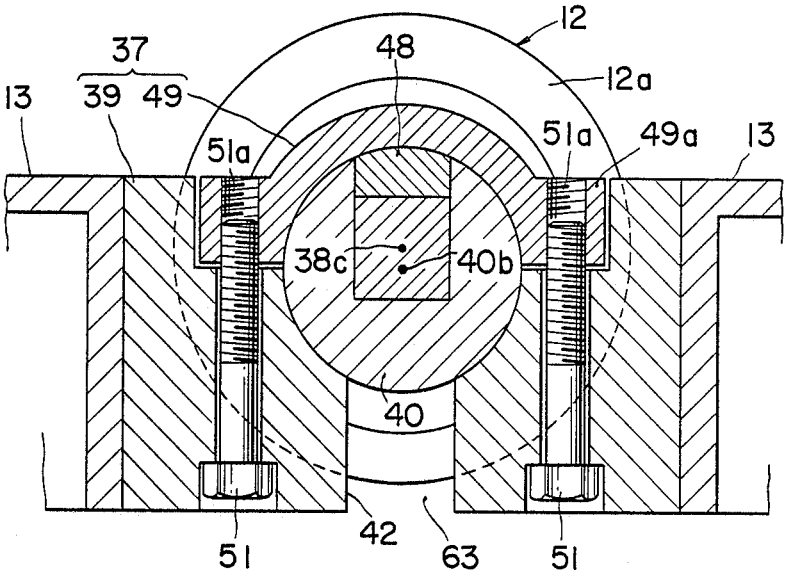
FIG. 11 is a view similar to FIG. 8 but showing alternative means for replaceably mounting each roller cutter.

In the case where the axis **38*c* of the cutter shaft extensions 38*a* is offset from the axis 40*b* of the rotary mounting disks 40 as in FIG. 11, the roller cutter 12 will orbit about the axis 40*b* as indicated by the phantom outlines in FIG. 10, with the periphery 38*d* of the tool grip 38*b* moving away from the stop 60. It will therefore be seen that the stop 60 on the clamp 49 does not interfere with such manual revolution of the roller cutter 12**.

It will now be apparent that each roller cutter 12 can be installed on the cutting disk 13 by the reversal of the foregoing dismounting procedure. With the rotary mounting disks 40 held in the angular position of FIG. 13, the cutter shaft extensions **38*a* and fillers 48 is slid successively into their radial slots 47 via the guide channels 42 in the cutter supports 49. Such insertion of the cutter shaft extensions 38*a* will be easier if the mounting disks 40 are constructed as shown in FIG. 12A or 12B, because then the radial slots 47** will widen under pressure from the shaft extensions.

Figure 13:
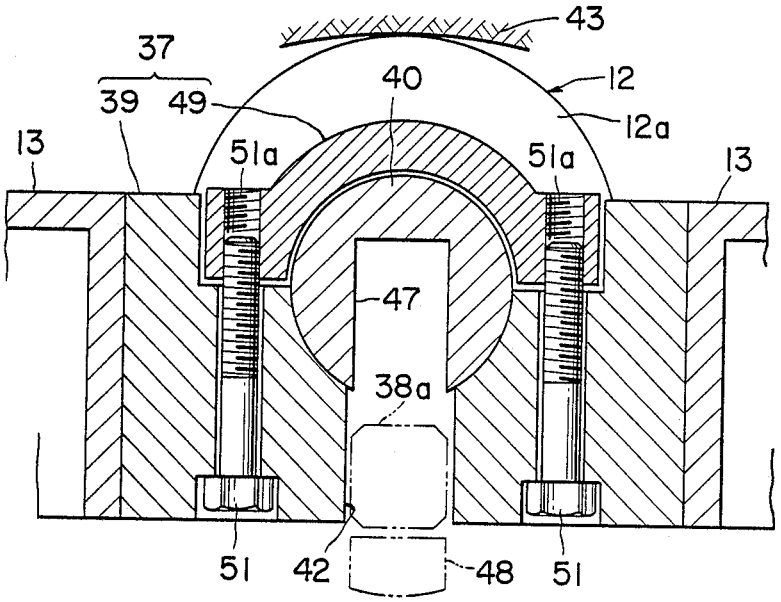
FIG. 13 is a view similar to FIG. 8 but explanatory of the way in which each roller cutter is mounted to and dismounted from the cutting disk.
Figure 14:
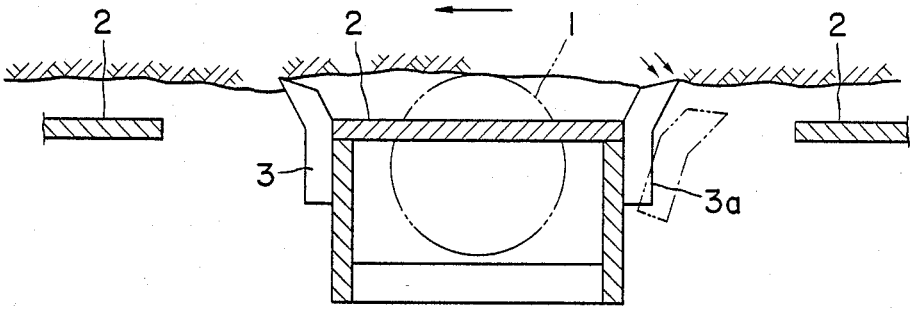
FIG. 14 PRIOR ART
FIG. 14 is a partial sectional illustration of the prior art cutting disk.
Figure 15:
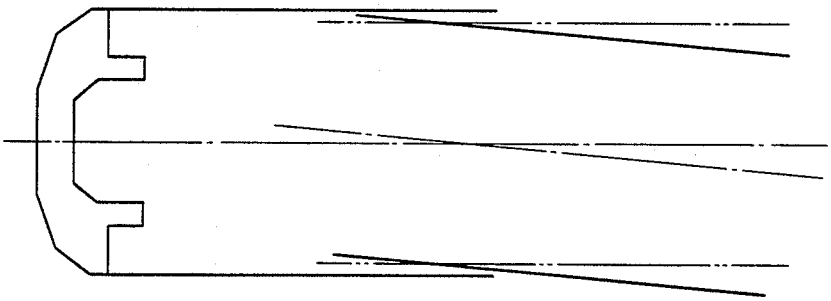
FIG. 15 PRIOR ART
FIG. 15 is a diagrammatic illustration of the conventional two-section shield shown being steered.

Then the mounting disks 40 with the cutter shaft 38 engaged therewith is revolved 180 degrees from their FIG. 13 position back to that of FIG. 8 by manually turning the tool grip **38*b*. Then, with the periphery 38*d* of the tool grip 38*b* held against the stop 60, if any, on the clamp 49, the screws 51 are tightened for drawing the clamps 49 into forced contact with the rotary mounting disks 40 and fillers 48. Now the mounting of the roller cutter 12 has been completed. The mounting disks 40 will more firmly engage the cutter shaft extensions 38*c* if they are slitted as in FIG. 12A or sprung as in FIG. 12**B.

It should be appreciated that each roller cutter 12 is readily mountable to, and dismountable from, the cutting disk 13 merely by loosening and tightening the screws 51 and bidirectionally revolving the cutter shaft 38 together with the rotary mounting disks 40. All such manual handling can be performed from within the cutting disk 13. There is accordingly no need for backing the excavator away from the tunnel face 43 to enable an operator to enter the space so created for the replacement of the roller cutters 12.

Mounted to the cutting disk 13 as in the foregoing, the roller cutters 12 will cut the tunnel face 43 as they rotate with the cutting disk, with the cutter rings **12*a* also revolving about the cutter shafts 38. Because of the unidirectional rotation of the cutting disk 13, each roller cutter 12 will receive the reactive force of excavation in one direction only. It will therefore be seen that only one stop 60 may be provided on each clamp 49 for bearing against the reactive force of the associated cutter shaft 38**.

Operation

For tunnel construction by the excavator shown in FIG. 1, the pair of rear anchor mechanisms 28 is first be actuated, hydraulically or otherwise, for thrusting the anchor members radially outwardly of the tail shield section 26, thereby anchoring the same against displacement relative to the tunnel surface. Then the drive motors 15 is set into rotation for revolving the cutting disk 13. The roller cutters 12 on the revolving cutting disk 13 will cut the tunnel face 43 as the push jacks 29 are extended for pushing the head shield section 11 away from the anchored tail shield section 26.

During such excavation, water is pumped into the slurry chamber 17 by way of the water conduit 31. The water will mingle with the muck or spoil that has fallen into the slurry chamber 17 through the intake openings 52 in the cutting disk 13. The slurried spoil is to be pumped away from the slurry chamber 17 by way of the slurry conduit 32.

As the cutting disk 13 rotates with the roller cutters 12 in cutting engagement with the tunnel face 43, the head shield section 11 will be constantly subject to torsional forces produced by reaction from the tunnel face. Such torsional forces will be transmitted to the inner shield section 18 via the longitudinal slides 23 and guides 24, the slides and guides being substantially rigidly interengaged in the circumferential direction of the shield sections 11 and 18, and thence to the tail shield section 26 via the pair of independent antirolling jacks 30. Finally, the torsional forces will be taken up by the rear anchor mechanisms 28 being held against the tunnel surface.

Upon extension of the push jacks 29 to a full or otherwise prescribed length, that is, upon excavation of a unit tunnel length, the cutting disk 13 is set out of rotation, and the front anchor mechanisms 25 is actuated for anchoring the head shield section 11 to the tunnel surface. Simultaneously, the rear anchor mechanism 28 is retracted for releasing the tail shield section 26 from the tunnel surface. Then, upon contraction of the push jacks 29, the tail shield section 26 will be dragged close to the head shield section 11. The inner shield section 18 will also travel forwardly with the tail shield section 26 as the slides 23 slide over the guides 24.

Subsequently, the tunnel surface portion that has been bared by the advance of the tail shield section 26 over the unit distance is lined by the erector mechanism 35 with the liner segments 36, as has been known heretofore.

One cycle of tunnel excavation has now been completed. The same cycle may be repeated for excavating further into the ground. It is to be noted, however, that the anchoring of the tail shield section 26 can be effectuated before, rather than after, the completion of the lining of the tunnel surface portion that has been bared at the end of each cycle. Thus, during the erection of the liner segments 36, the front anchor mechanisms 25 on the head shield section 11 may be deactivated, and the cutting of the tunnel face may be recommended. If the tail shield section 26 is insufficiently anchored against backing by the rear anchor mechanisms 28, the auxiliary jacks 33 may be used for transmitting the thrust loads of the primary jacks 29 to the erected liner segments 36.

The circumferntial arrangement of the push jacks 29, as best seen in FIG. 6, is well calculated for the steering of the excavator by these jacks. The strokes of the push jacks 29 may be selectively varied for steered advancement of the head shield section 11. Since the inner shield section 18 and tail shield section 26 are interconnected by the collapsible seal 27, the head shield section 11 is steerable within limits both horizontally and vertically with respect to the tail shield section 26. As the head shield section 11 is so steered and advances, the tail shield section 26 will follow the head shield section by virtue of the steerable connection between inner shield section 18 and tail shield section 26.

What is claimed is:

1. A shielded tunnel excavator comprising:

(a) a substantially tubular shield comprising:

(1) a head section having a front end and a rear end;

(2) an inner section telescopically nested in the head section and rigidly constrained to axial displacement relative to the same; and (3) a tail section coupled to the inner section for both bending and rolling movements relative to the same;

(b) front anchor means for anchoring the head section of the shield to a tunnel surface;

(c) rear anchor means for anchoring the tail section of the shield to the tunnel surface;

(d) rotary cutting means rotatably mounted to the front end of the head section of the shield;

(e) drive means within the shield for imparting rotation to the rotary cutting means;

(f) propelling means connected between the head section and tail section of the shield for advancing the shield; and (g) a pair of antirolling jacks connected between the inner section and tail section of the shield so as to extend substantially tangentially of the shield.

2. The tunnel excavator of claim 1 wherein the head section of the shield is greater in outside diameter than the tail section of the shield.

3. The tunnel excavator of claim 1 further comprising means for slidably sealing lapping portions of the head section and inner section of the shield.

4. The tunnel excavator of claim 1 wherein the inner section of shield is rigidly constrained to axial displacement relative to the head section by:

(a) axial guide means formed on either of the head section and inner section of the shield; and (b) slide means formed on the other of the head section and inner section of the shield for sliding along the guide means;

(c) the guide means and the slide means being interengaged so as to substantially rigidly restrain the head section and inner section of the shield from relative rotation about the axis of the shield.

5. The tunnel excavator of claim 1 wherein the rotary cutting means comprises:

(a) a cutting disk rotatably mounted to the front end of the head section of the shield; and (b) a plurality of roller cutters rotatably mounted to the cutting disk for cutting engagement with the face of the tunnel being excavated.

6. The tunnel excavator of claim 5 further comprising mounting means rotatably supporting each roller cutter on the cutting disk so as to permit mounting and dismounting of the roller cutter from that side of the cutting disk away from the tunnel face.

7. The tunnel excavator of claim 5 wherein a space is formed between the cutting disk and the shield and wherein the cutting disk has defined therein a plurality of spoil intakes for admitting spoil into the space.

8. The tunnel excavator of claim 7 further comprising:

(a) a water conduit extending through the shield for introducing water into the space between the cutting disk and the shield and hence for slurrying the spoil contained therein; and (b) a slurry conduit extending through the shield for discharging the slurried spoil from the space.

9. The tunnel excavator of claim 1 further comprising erector means within the tail section of the shield for erecting tunnel liner means.

10. The tunnel excavator of claim 1 wherein the pair of antirolling jacks extend parallel to each other and are disposed in positions of symmetry about the axis of the shield.

* * * * *